United States Patent [19]

Morgan

[11] 4,191,296

[45] Mar. 4, 1980

[54] ARTICLE DISPENSING RACK

[76] Inventor: J. Robert Morgan, Palmer Hill Rd., Old Greenwich, Conn. 06870

[21] Appl. No.: 738,284

[22] Filed: Nov. 3, 1976

[51] Int. Cl.[2] ..... A47F 3/024

[52] U.S. Cl. ..... 211/49 D; 211/150; 312/45

[58] Field of Search ..... 211/49 R, 49 D, 150, 211/168, 126, 151, 169.1, 170, 173, 184; 312/35, 42, 45, 49, 72, 73, 242; 108/7; 248/371, 397, 398

[56] References Cited

U.S. PATENT DOCUMENTS

| | | | |
|---|---|---|---|
| 1,745,784 | 2/1930 | Davis | 211/126 X |
| 2,160,102 | 5/1939 | Hull | 211/49 D |
| 2,218,444 | 10/1940 | Vineyard | 211/49 D |
| 2,249,234 | 7/1941 | Srodulski | 211/184 X |
| 2,302,387 | 11/1942 | Greeno et al. | 248/371 X |
| 2,744,634 | 5/1956 | Conley, Jr. | 312/45 X |
| 3,272,528 | 9/1966 | Young et al. | 280/79.3 X |
| 3,361,505 | 1/1968 | Newberry | 312/45 |
| 3,981,511 | 9/1976 | Foster | 211/150 X |

FOREIGN PATENT DOCUMENTS

| | | | |
|---|---|---|---|
| 809367 | 7/1951 | Fed. Rep. of Germany | 211/49 D |
| 20309 | 12/1907 | United Kingdom | 211/150 |

*Primary Examiner*—Roy D. Frazier
*Assistant Examiner*—Robert W. Gibson, Jr.
*Attorney, Agent, or Firm*—Eugene E. Geoffrey, Jr.

[57] ABSTRACT

A rack for dispensing articles which includes a plurality of shelves divided into discrete channels and positioned one above the other. The shelves are each pivoted to supporting means at a point between the ends thereof and means are provided to position the shelves at one inclination for loading and at another inclination for dispensing the loaded articles.

7 Claims, 7 Drawing Figures

ARTICLE DISPENSING RACK

This invention relates to dispensing apparatus and more specifically to a novel and improved rack particularly useful among other things for dispensing goods packaged in containers such as cans, bottles, boxes, and the like.

A wide variety of racks have been provided in the past which utilized gravity to feed articles to a position where they may be readily withdrawn. Known racks, however, do not hold a wide variety of articles and loading of the racks constitutes a relatively difficult problem. Accordingly known dispensers have not been generally found to be more convenient than conventional shelves.

This invention has as one of its objects the provision of novel and improved rack that is arranged and designed for convenient loading of articles and at the same time permits the articles to be easily withdrawn. One of the more difficult problems entailed with dispensers involves the handling of articles packaged in glass bottles as they may be easily broken in the loading process. Moreover, many articles and particularly bottled articles have labels of paper or other similar materials that are easily damaged upon the withdrawal of a bottle from the rack. By reason of the design and arrangement of the rack in accordance with the invention accidental breakage of bottled goods and label damage is virtually eliminated.

Another object of the invention resides in the provision of a novel and improved rack comprising a plurality of shelves interconnected one with the other and wherein the slope of the shelves may be readily modified to reduce the degree of slope for loading and increase the degree of slope after the loading operation has been completed so that the articles will readily be fed under the influence of gravity to the withdrawal point.

Another object of the invention resides in the provision of a novel and improved rack for dispensing bottled articles.

The rack in accordance with the invention includes a plurality of shelves having dividers spaced across the width of each shelf to provide for the handling of a plurality of different articles and wherein each of the shelves are pivoted at a point spaced from one end thereof and means are provided for shifting the angle of tilt of each shelf so that a small angle is provided for loading and a larger angle for insuring a uniform feed of the articles to the withdrawal point. When handling relatively heavy articles such as bottled liquids and the like, pivoting of the shelves at points between the ends thereof greatly facilitates raising of the shelves to increase the angle of inclination after loading has been completed.

The above and other objects and advantages of the invention will become apparent from the following description and accompanying drawings forming part of this application.

Figure 1:
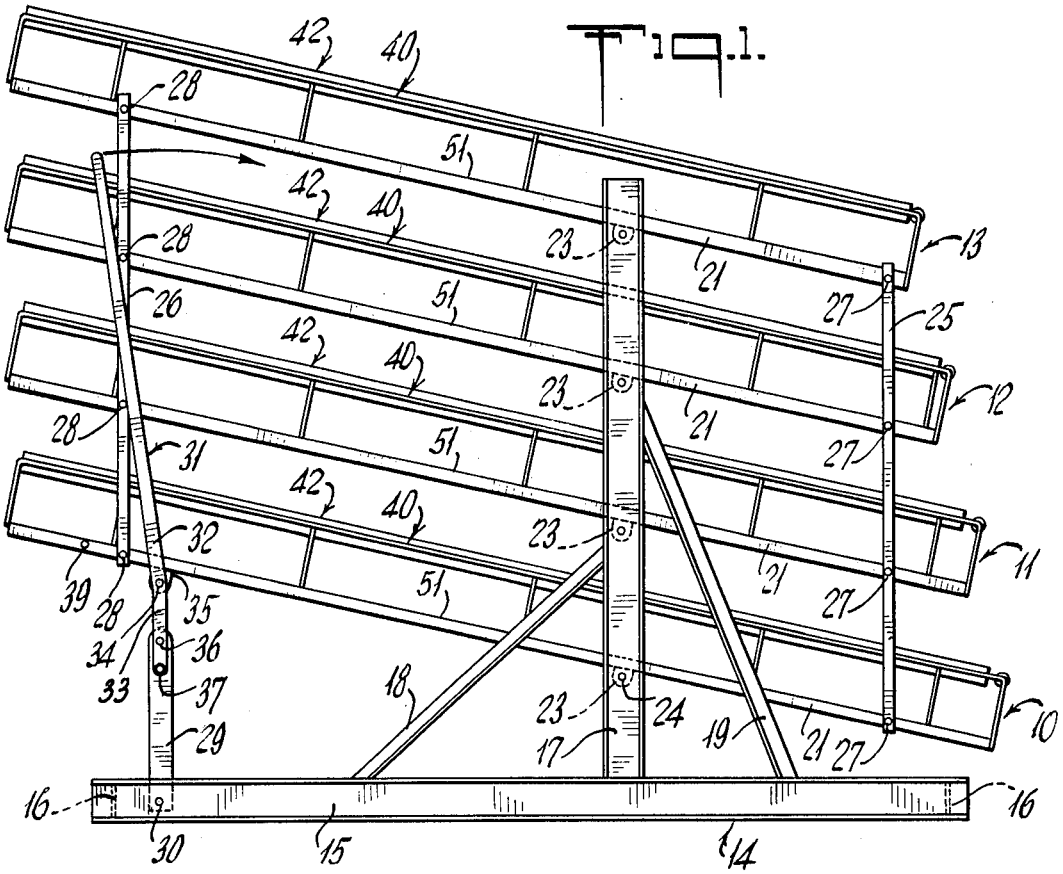
FIG. 1 is a side elevational view of one embodiment of the rack in accordance with the invention and with the shelves at one angle of inclination.

Referring now to the drawings, the illustrated embodiment of the invention comprises four shelves 10, 11, 12, and 13, though it is evident that any desired number of shelves may be utilized on a single rack. The vertical spacing between the shelves is determined by the height of the articles to be dispensed thereby and the forward ends of the shelves, namely the righthand portions as illustrated in FIG. 1, are preferably escheloned so that the shelf 11 is set back from the shelf 10 and each succeeding shelf is set back from the shelf below. The shelves 10 through 13 are supported by a suitable base generally denoted by the numeral 14 which in the instant embodiment of tiie invention includes side members 15 and front and rear members 16 which form essentially a rectangle. It is obvious that while the base as illustrated is formed of channel iron, it could be made in any desirable manner.

The base 14 carries a pair of oppositely disposed vertical members 17 which are attached to the sides 15 of the base by welding or other suitable means and are maintained in the upright position by diagonal braces 18 and 19. While only one upright member is illustrated in the drawings it is understood that the same structure is formed on each side for the purpose of supporting the shelves.

Figure 6:
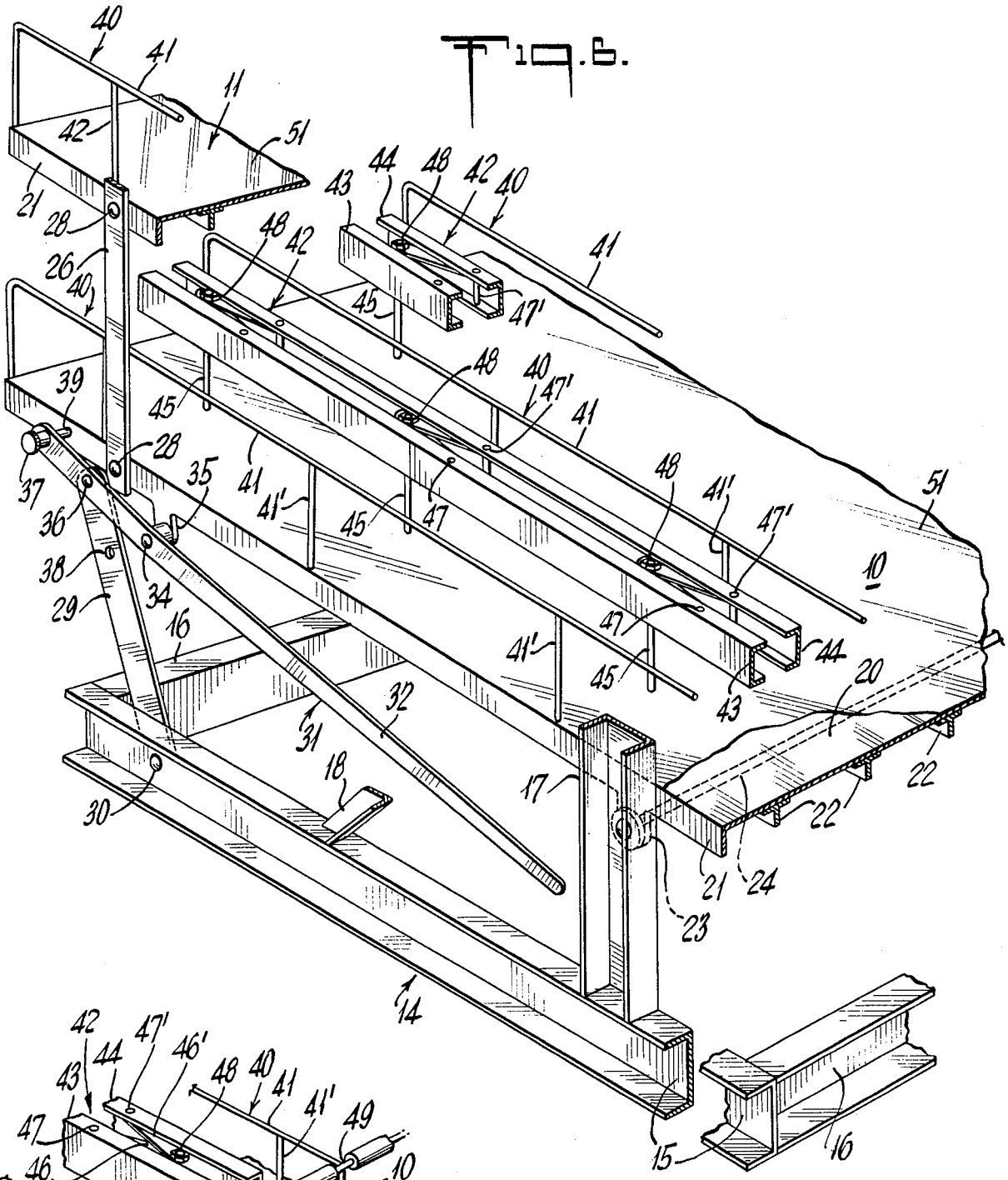
FIG. 6 is an enlarged perspective view of a fragmentary portion of the structure shown in FIGS. 1 and 2.
Figure 7:
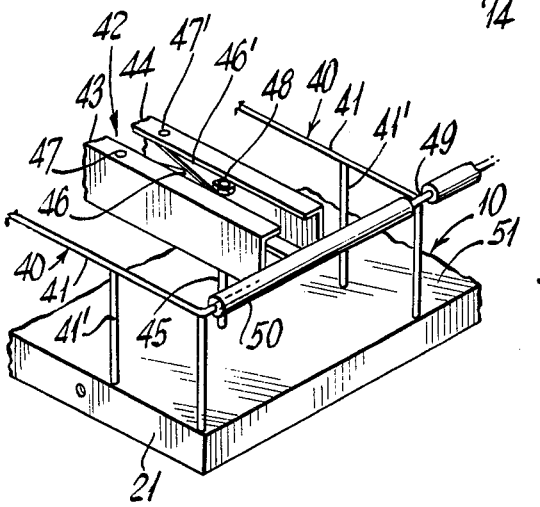
FIG. 7 is a perspective view of another fragmentary portion of the structure shown in FIGS. 1 and 2.

Each of the shelves 10 through 14 are substantially identical and the structure of shelf 10 is illustrated in detail in FIGS. 6 and 7. Referring to these figures it will be observed that the shelf 10 is formed of sheet metal having a base 20 and downwardly formed flanges 21 on all four edges thereof. In addition, T-shaped reinforcing elements 22 may be welded or otherwise secured to the bottom of the base 20 in order to provide adequate support for the articles to be carried thereby. The side flanges 21 each include a downwardly extending member 23 having an opening therein for receiving a transverse supporting rod extending through cooperating openings in the vertical supports 17. The rod denoted by the numeral 24 in FIG. 6 may be secured in position by any suitable means so that it will be maintained in engagement with the two side supports 17 as well as the bearing members 23 on each side of the shelf 10. If desired, the shelf 10 can be constructed to be self supporting in which case pivot pins could be utilized to pivot each of the bearing members 23 to its associated vertical support 17. It is, of course, obvious that the shelves 11 through 13 would be similarly attached to the vertical members 17.

Figure 2:
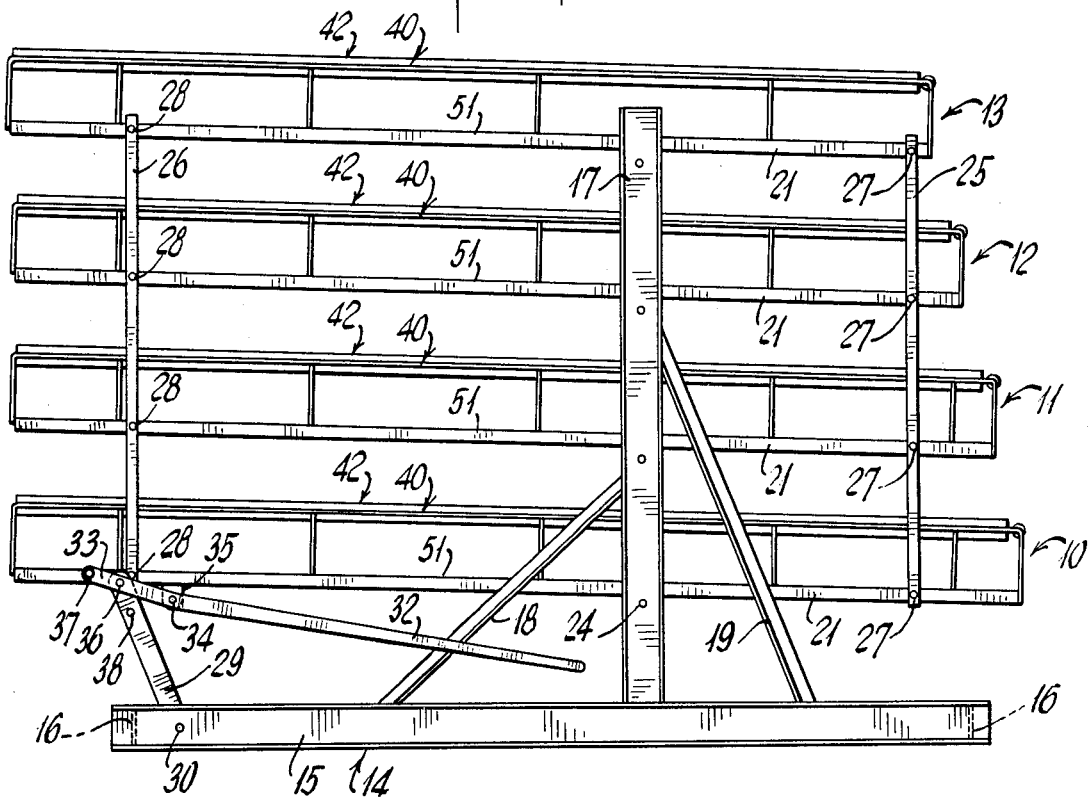
FIG. 2 is a view similar to FIG. 1 with the shelves positioned at a lowerer angle of inclination.

The four shelves 10 through 13 are held in parallel relationship by sets of vertical supports 25 and 26 at the front and rear portions thereof. The vertical braces 25 on each side cf the forward portion of the shelves are pivoted at points 27 to each of the depending flanges 21 and similarly the members 26 on each side of the rear portions of the shelves are pivoted to the flanges 21 at points 28. Thus, with the arrangement as described, it is evident that the four shelves can be pivoted relative to the vertical supports 17 so that the inclination thereof can be modified as desired. Normally the shelves would be maintained in a position generally shown in FIG. 1 for the purpose of dispensing articles, while when loading articles on the shelves, they would be placed in a position as shown in FIG. 2 in order to reduce the inclination thereof. This is most important when utilizing the shelves for dispensing bottled goods since breakage may occur upon insertion of the bottles from the left-hand side of the rack as shown in FIG. 1 as they would slide with substantial velocity toward the righthand end with the result that contact of a moving bottle with a bottle previously inserted would damage, if not break, one or the other of the bottles. By reducing the slope of the shelves to a point wherein the inclination will not permit the bottle to slide under the influence of gravity, it is not possible for any damage to occur.

The inclination of the shelves from and to the position shown in FIG. 1 may be accomplished in any desired manner. While mechanical means are provided for elevating the shelves from the position shown in FIG. 2 to the position shown in FIG. 1 it is evident that hydraulic or pneumatic cylinders could be used with equal effectiveness. In the specific embodiment of the invention, a first lever 29 is pivoted at 30 to the frame member 15. A second cooperating lever 31 has a relatively long upper portion 32 and a relatively short lower portion 33. The portion 33 is offset from the portion 31 for convenience, though of course it is evident that both portions of this lever could be in line. The lever 31 is pivoted at 34 to a member 35 depending from the flange 21 of the shelf 10 and the lower end 33 of the lever 31 is pivoted at 36 to the upper end of the lever 29. It is evident that by moving the lever in a clockwise direction as shown in FIG. 1 that the rear portions of the shelves will be lowered to the position as shown in FIG. 2. If desired, locking means generally denoted by the numeral 37 may be carried at the lower end of the lever 31 and arranged to engage an opening 38 in lever 29 when the shelves are in the position shown in FIG. 1. When the shelves are positioned as shown in FIGS. 2 and 6, the locking means 37 would engage an opening 39 in the flange 21 of the shelf 10 as illustrated more clearly in FIG. 6.

Figure 3:
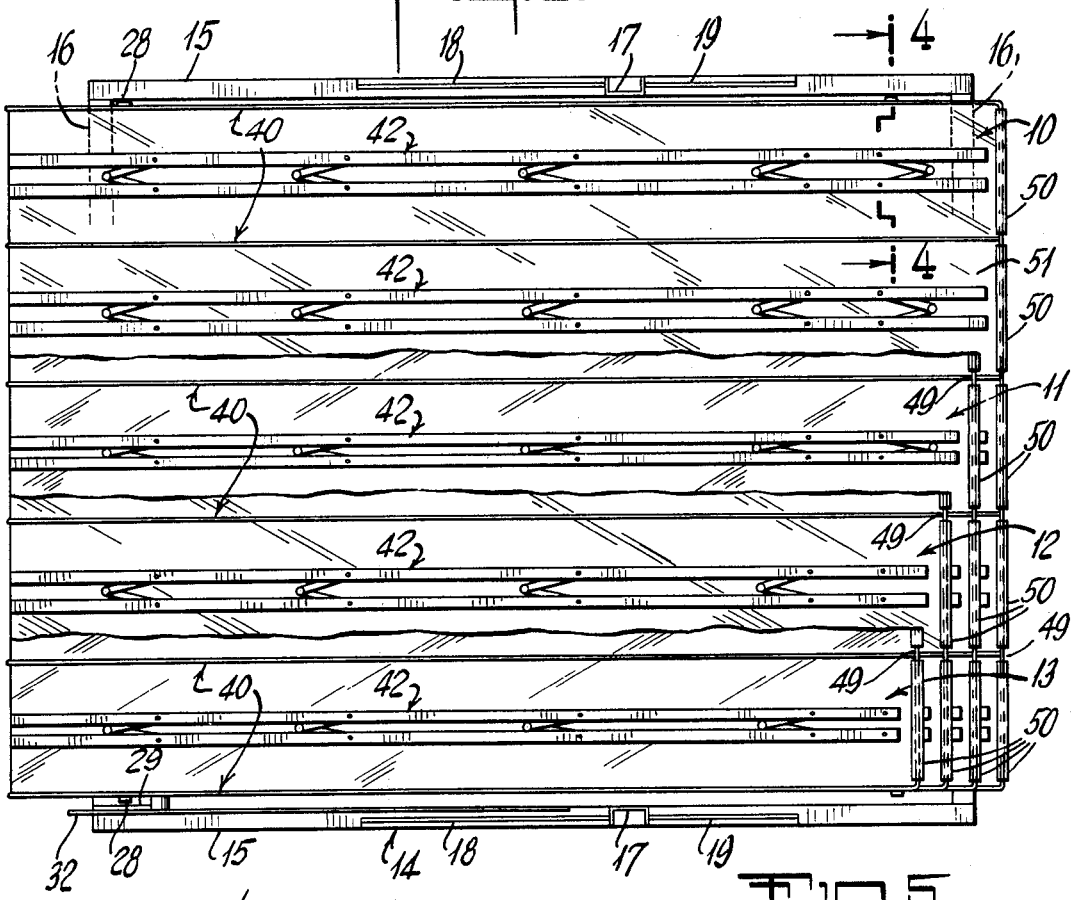
FIG. 3 is a plan view of the rack shown in FIGS. 1 and 2.
Figure 4:
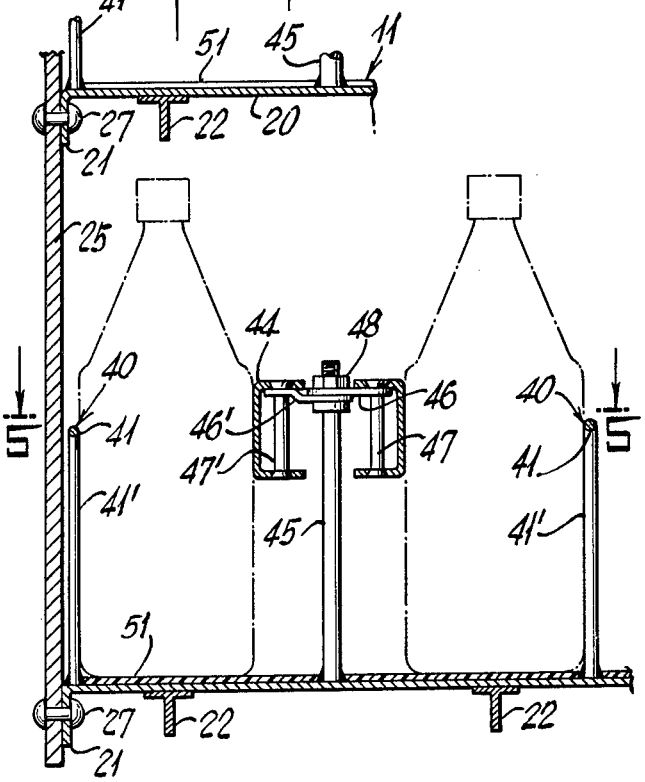
FIG. 4 is a cross-sectional view of FIG. 3 taken along the line 4—4 thereof.
Figure 5:
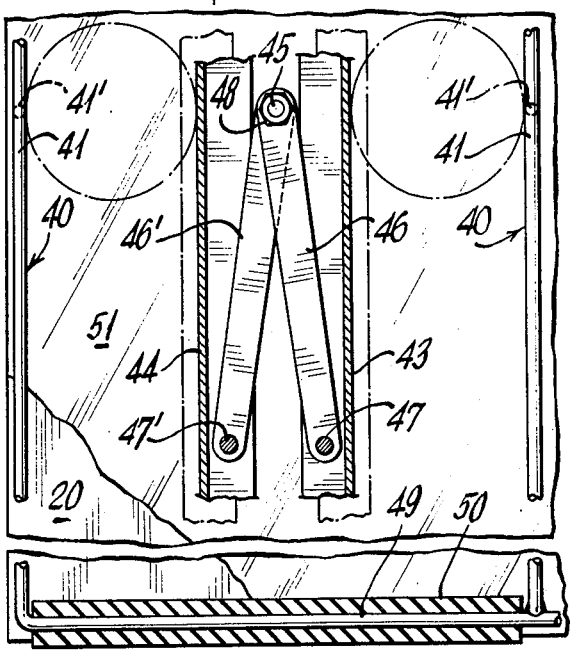
FIG. 5 is a cross-sectional view of FIG. 4 taken along the line 5—5 thereof.

Each of the shelves 10 through 13 are partitioned to provide channels for the receipt of items to be dispensed and means and provided for adjusting the width of each channel so that the items in a given channel will remain in alignment, one with the others. Referring to FIGS. 3 and 6 it will be observed that each shelf has a plurality of fixed dividers 40 which are spaced at sufficient distances to define two channels. In the instant embodiment of the invention, these dividers consist of horizontal rods 41 supported by posts 42, the latter being secured to the base 20 of the shelf. Between each pair of dividers 40 there is a central adjustable divider generally denoted by the numeral 42 which includes in the instant embodiment of the invention a pair of U-shaped members 43 and 44 which are supported by posts 45. The members 43 and 44 are connected to each post by arms 46 and 46' which are pivoted to the members at points 47 and 47' respectively. The other ends of the arms 46 and 46' are fastened to a post 45 and held in position by a nut 48. Since a series of these arms 46 and 46' are provided throughout the length of each pair of members 43 and 44 they can be adjusted to provide article dispensing channels of the desired widths to insure that the articles in each channel will remain in alignment, one with the others.

The forward end of each of the article dispensing channels is closed by a transverse rod 49 which is preferably covered bgy a resilient sleeve 50 in order to avoid damage to either the article or the label that may appear thereon and by making the sleeve 50 rotatable, removal of an article will be facilitated.

It is desirable to provide each shelf with a surface material 51 that will afford the desired friction with the article to be dispensed. By utilizing a material having a fairly low coefficient of friction, the inclination of the shelves can be materially reduced. It has been found that desired surface coatings for the shelves may comprise metals or plastics such as ultra high molecular weight polyethelenes and the like. In certain cases rollers may also be employed, depending upon the nature of the articles.

With dispensing apparatus as described above, a wide variety of articles can be dispensed within a relatively small area and at the same time loading can be easily effected from the rear portions of the shelves and without interfering with the dispensing of articles already on the shelves. Furthermore, inasmuch as the shelves are pivoted at points spaced from the dispensing end thereof, the shelves can be readily tilted even in the fully loaded position since the articles disposed forwardly of the vertical supports 17 will counterbalance at least a portion of the articles disposed to the rear of the vertical supports 17. As a result, the equipment required for modifying the tilt of the shelves for loading and dispensing operations can be greatly simplified.

The illustrated embodiment of the invention provides for rear loading, and accordingly, the shelves are moved between two angles of inclination, one being shallow for loading and the other steeper to insure feeding of the articles to the withdrawal point. It is apparent, however, that the shelves can also be arranged for front loading in which case the inclination of the shelves would be in one direction for loading to cause articles to move to the rear and in the reverse direction for feeding articles forwardly to the withdrawal points.

While only one embodiment of the invention has been illustrated and described, it is apparent that alterations, changes and modifications may be made without departing from the scope and spirit thereof.

What is claimed is:

1. A rack for dispensing articles comprising a base, a plurality of inclined shelves each pivotally supported by said base at points between the ends thereof, each shelf having at least one partition to define at least two channels, said partition including fixed support means defining a line extending between the ends of said shelf and partitioning means carried on each side of said support means, said support means being independently adjustable to fix the width of each of said channels, means at the lower or article withdrawal end of each of said shelves for retaining articles thereon which are fed toward said end by gravity and means for changing the inclination of said shelves.

2. A rack for dispensing articles according to claim 11 wherein said shelves are each pivoted at points between the centers thereof and said lower ends and said linkage mechanism connects to said shelf proximate the upper end thereof.

3. A rack for dispensing articles according to claim 1 wherein said shelves are disposed one above the other and said base includes a pair of upright members disposed at the sides of said shelves and said shelves are pivoted to said members.

4. A rack for dispensing articles according to claim 1 wherein said withdrawal ends of said shelves are echeloned to facilitate access to each shelf.

5. A rack for dispensing articles according to claim 1 wherein the lower end of each channel is closed by a resilient member to retain the articles in said channels.

6. A rack for dispensing articles according to claim 1 wherein said shelves are loaded from the rear and said inclination changing means moves said shelves between two inclinations wherein the withdrawal ends of the shelves are always below a horizontal.

7. A rack for dispensing articles comprising a base, a plurality of inclined shelves each being pivotally supported by said base at points between the ends thereof, means at the lower or article withdrawal end of each of said shelves for retaining articles thereon which are fed toward said end by gravity and means for changing the inclination of said shelves to facilitate loading articles on said shelves and returning the loaded shelves to the first said inclination to insure displacement of the articles toward the withdrawal ends of said shelves as articles are removed therefrom, said means for changing the inclination of said pivotally supported shelves including a linkage mechanism interconnecting said base and at least one of said shelves proximate an end of said shelf whereby a mechanical advantage is provided in pivoting said shelves, said shelves including spaced partitions extending between the ends thereof to form discrete channels for retaining a plurality of rows of articles to be dispensed, and at least one of said partitions including a fixed line of supports and adjustable means carried on each side of said line of supports for individually modifying the width of the channels on each side thereof to accommodate articles of specific dimensions.

* * * * *